US010111548B1

(12) United States Patent
Dry et al.

(10) Patent No.: US 10,111,548 B1
(45) Date of Patent: Oct. 30, 2018

(54) MAILBOX AND BARRIER MEMBER THEREFOR

(71) Applicant: SOLAR GROUP, INC., Taylorsville, MS (US)

(72) Inventors: J. Derrick Dry, Laurel, MS (US); Brian Lavon Roney, Laurel, MS (US)

(73) Assignee: SOLAR GROUP, INC., Taylorsville, MS (US)

( * ) Notice: Subject to any disclaimer, the term of this patent is extended or adjusted under 35 U.S.C. 154(b) by 0 days.

(21) Appl. No.: 15/891,684

(22) Filed: Feb. 8, 2018

(51) Int. Cl.
*A47G 29/126* (2006.01)
*E06B 7/16* (2006.01)

(52) U.S. Cl.
CPC ..... *A47G 29/126* (2013.01); *E06B 7/16* (2013.01)

(58) Field of Classification Search
CPC ..... A47G 29/1209; A47G 29/126; A47G 29/122; E06B 7/16
USPC ..... 232/17, 38, 45, 29; 49/483.1, 490.1
See application file for complete search history.

(56) References Cited

U.S. PATENT DOCUMENTS 3,990,629 A 11/1976 Hodge
4,181,250 A * 1/1980 Withrow ..... A47G 29/1205 232/1 C
4,275,829 A * 6/1981 Johnson ..... A47G 29/1209 220/4.34
4,951,905 A 8/1990 Bronson et al.
5,337,954 A 8/1994 Kobilarcik et al.
6,543,680 B1 4/2003 McCormack
6,808,108 B1 * 10/2004 Turnbow ..... A47G 29/1209 232/17
7,090,119 B1 * 8/2006 Lackey ..... A47G 29/1209 232/17
7,178,717 B1 * 2/2007 Lindell ..... A47G 29/1209 232/45
7,182,244 B2 * 2/2007 Brown ..... A47G 29/1203 220/651
7,252,221 B1 * 8/2007 Bowers ..... A47G 29/1209 232/17
7,527,190 B1 * 5/2009 Bowers ..... A47G 29/1209 232/17
8,104,732 B1 1/2012 Robinson et al.
8,616,436 B2 * 12/2013 Brewer ..... A47G 29/1209 232/29
8,757,476 B2 * 6/2014 Childress ..... A47G 29/1209 232/17
2002/0190116 A1 * 12/2002 Lackey ..... A47G 29/1209 232/17
2006/0065706 A1 * 3/2006 Ranen ..... A47G 29/1209 232/45

* cited by examiner

*Primary Examiner* — William L Miller
(74) *Attorney, Agent, or Firm* — Eckert Seamans Cherin & Mellott, LLC

(57) ABSTRACT

A barrier member is for a mailbox. The mailbox has a floor member, a wrap member coupled to the floor member, and a door pivotably coupled to the floor member. The door is structured to pivot between an open position and a closed position. The barrier member includes a first segment, a second segment opposite and located substantially parallel to the first segment, and a band connecting the first segment to the second segment. The barrier member is structured to sealingly cooperate with the door.

15 Claims, 11 Drawing Sheets

MAILBOX AND BARRIER MEMBER THEREFOR

BACKGROUND

Field

The disclosed concept relates to mailboxes. The disclosed concept also relates to barrier members for mailboxes.

Background Information

Mailboxes commonly have to pass certification tests in order to be properly certified. For example, Underwriters Laboratories Inc. ("UL"), headquartered in Northbrook, Ill., is known to make and distribute a test standard for mailboxes. Some mailboxes have to be certified by the United States Postal Service ("USPS") through successful testing results at a third party laboratory. One reason mailboxes must pass these certification tests is that the USPS will not deliver parcels of mail to a mailbox that has failed to pass certain required tests, as that mailbox may be compromised. One certification test, UL 771, for example, involves a setup having nozzles that spray water in a consistent manner. The USPS application of this setup involves spraying a mailbox with the nozzles for an extended period of time, typically 60 minutes, and requiring that no water enter the interior of the mailbox, except for condensation. Many known mailboxes have difficulty passing this test, which is designed to ensure that parcels of mail within mailboxes remain dry during, for example, thunderstorms.

There is thus room for improvement in mailboxes and in barrier members therefor.

SUMMARY

These needs and others are met by embodiments of the disclosed concept, which are directed to an improved mailbox and barrier member therefor.

As one aspect of the disclosed concept, a barrier member is provided for a mailbox. The mailbox has a floor member, a wrap member coupled to the floor member, and a door pivotably coupled to the floor member. The door is structured to pivot between an open position and a closed position. The barrier member includes a first segment, a second segment opposite and located substantially parallel to the first segment, and a band connecting the first segment to the second segment. The barrier member is structured to sealingly cooperate with the door.

As another aspect of the disclosed concept, a mailbox includes a plurality of components comprising a floor member, a wrap member coupled to the floor member, a door pivotably coupled to the floor member, the door being structured to pivot between an open position and a closed position, and the aforementioned barrier member.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. It will be appreciated that as used herein, features such as a band "connecting" a segment to another segment, for example, explicitly include an embodiment wherein all of the foregoing are a unitary component made from a single piece of material.

As employed herein, the statement that two or more parts or components "engage" one another shall mean that the parts touch and/or exert a force against one another either directly or through one or more intermediate parts or components.

As employed herein, the term "coupling member" refers to any suitable connecting or tightening mechanism expressly including, but not limited to, rivets, screws, bolts, and the combinations of bolts and nuts (e.g., without limitation, lock nuts), washers and nuts, zip ties, and wire ties.

Figure 1:
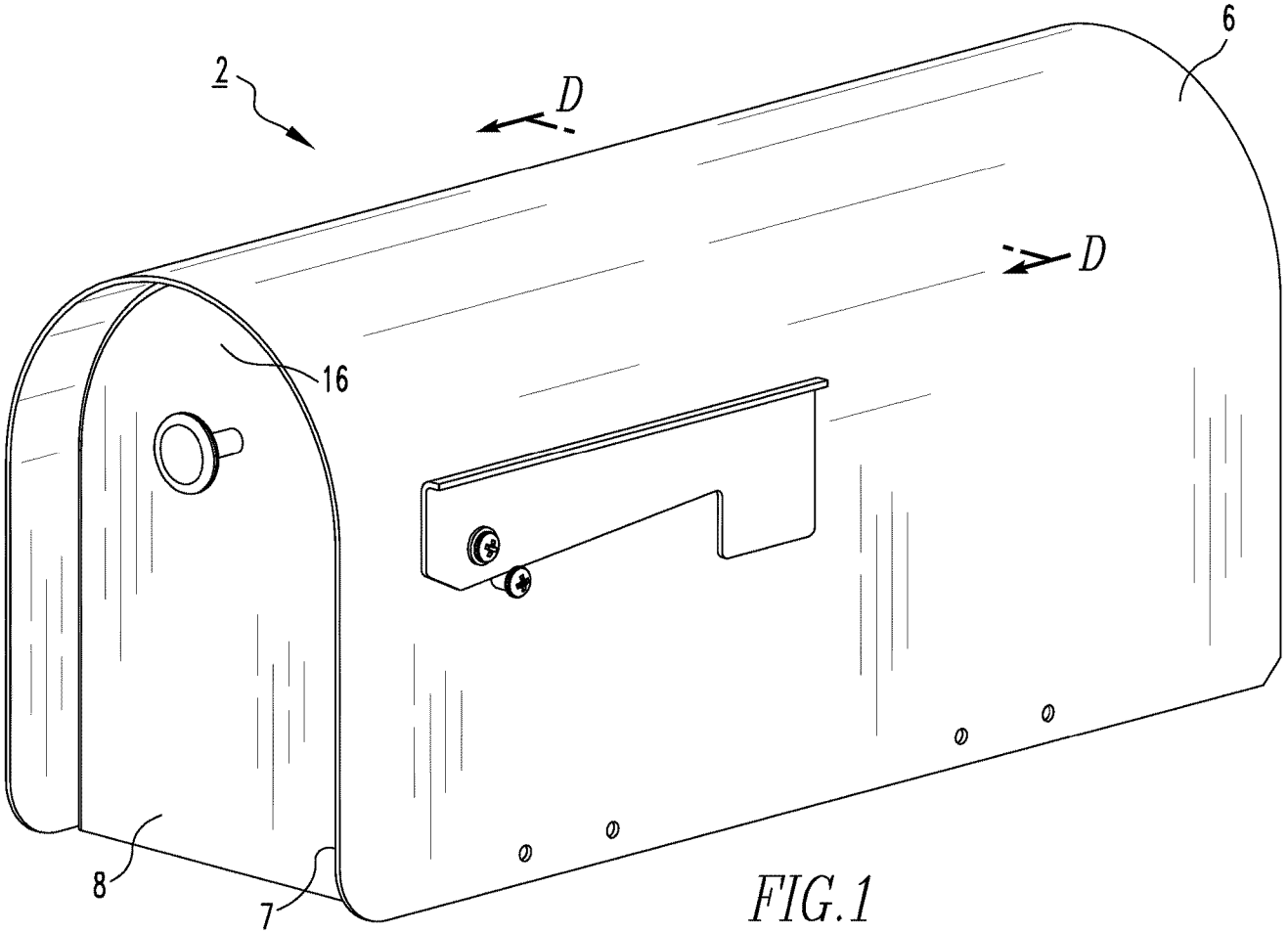
FIG. 1 is a front isometric view of a mailbox, shown with a door in a closed position, in accordance with one non-limiting embodiment of the disclosed concept.
Figure 2:
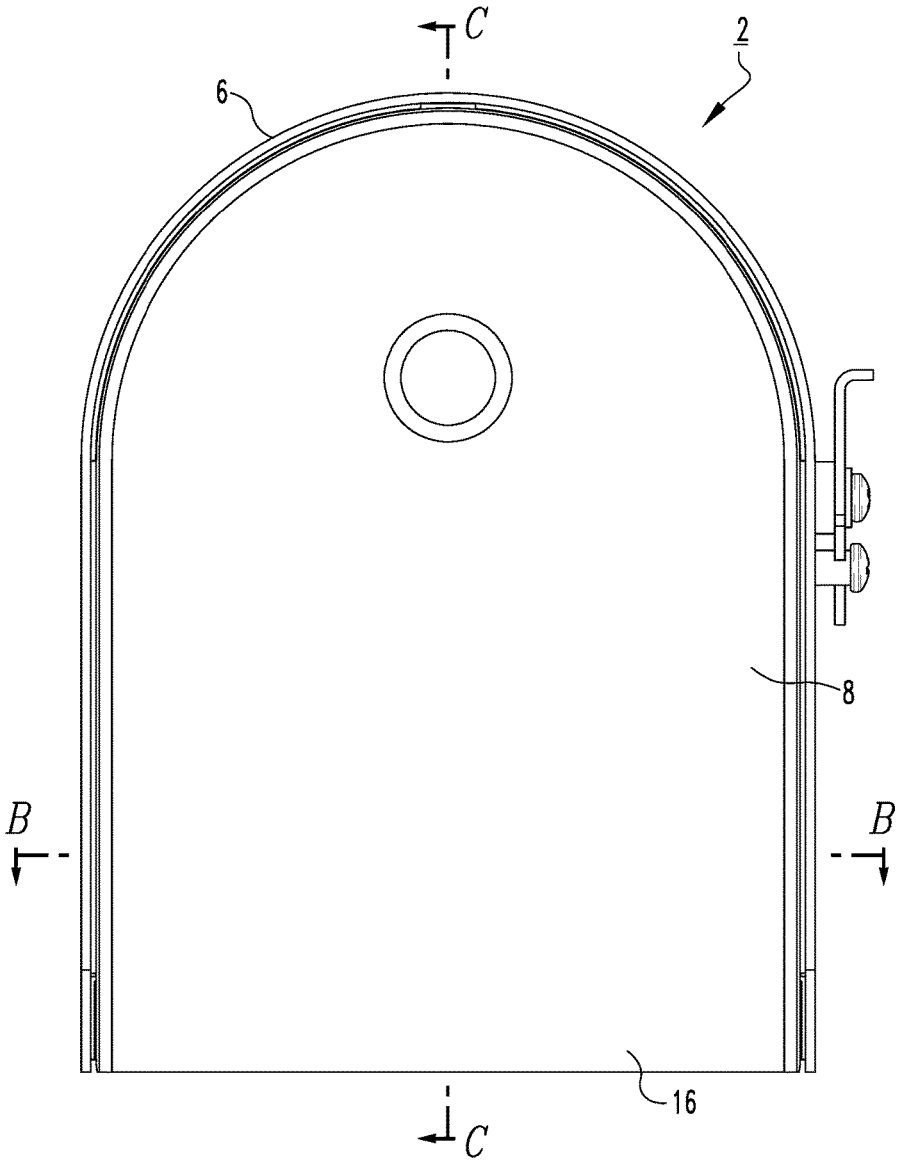
FIG. 2 is a front view of the mailbox of FIG. 1.

FIGS. 1-4 are different views of a mailbox 2 and barrier member 100 therefor, in accordance with one non-limiting embodiment of the disclosed concept. The mailbox 2 includes a floor member 4 (shown in FIGS. 3 and 4), a wrap member 6 coupled to the floor member 4, a door 8, and a novel barrier member 100 (shown in FIGS. 3 and 4). Additionally, the mailbox 2 includes a number of other components (e.g., without limitation, panel 10 (shown in FIG. 4) and hinge member 12 (shown in FIGS. 3 and 4). The door 8 is pivotably coupled to the floor member 4 via the hinge member 12, and is structured to pivot between an open position (FIG. 3) and a closed position (FIGS. 1 and 2). Furthermore, the door 8 has a body 16 and a peripheral flange 18 extending outwardly from the body 16. The panel 10 is coupled to the wrap member 6 and the floor member 4 in order to seal a rear portion of the mailbox 2. As will be discussed in greater detail below, the barrier member 100 is structured to sealingly cooperate with the door 8 in order to substantially minimize the likelihood that water such as, from a thunderstorm or during UL testing, will enter into the interior of the mailbox 2. This provides advantages in that parcels of mail within the mailbox 2 will generally remain dry during a thunderstorm, and the mailbox 2 will advantageously be able to pass UL 771 certification testing.

The geometry of the novel barrier member 100 will now be discussed in connection with FIGS. 5-9, which each show a different view of the barrier member 100. The barrier member 100 has first and second opposing and substantially parallel segments 110,120, and a band 150 connecting the first segment 110 to the second segment 120. The first and second segments 110,120 each have a corresponding coupling portion 112,122, a corresponding extension portion 114,124, and a corresponding connecting portion 116,126 connecting the coupling portions 112,122 to the extension portions 114,124. The coupling portions 112,122 are each structured to be coupled to the wrap member 6 (FIGS. 1-4), as will be discussed in greater below. The extension portions 114,124 are offset from the coupling portions 112,122, and as shown, the band 150 is spaced from the coupling portions 112,122. As shown most clearly in FIG. 5, the band 150 connects the first extension portion 114 to the second extension portion 124. In one example embodiment, the first coupling portion 112 is spaced from and located substantially parallel to the first extension portion 114. The second coupling portion 122 is spaced from and located substantially parallel to the second extension portion 124. The couple portions 112,122 and extension portions 114,124 are each substantially planar.

Continuing to refer to FIGS. 5-9, the band 150, which is structured to be concave facing the floor member 4 (FIGS. 3 and 4), includes a first side 152, a second side 154 located opposite the first side 152, and a tab 156 connecting the first side 152 to the second side 154. The tab 156 has a coupling portion 158, an extension portion 160 offset from the coupling portion 158, and a connecting portion 162 connecting the coupling portion 158 to the extension portion 160. The first side 152 extends from the first extension portion 114 to the extension portion 160 of the tab 156. The second side 154 extends from the second extension portion 124 to the extension portion 160 of the tab 156. The coupling portion 158 of the tab 156 is structured to be coupled to the wrap member 6 (FIGS. 1-4), as will be discussed below. The coupling portion 158 of the tab 156 is spaced from and located substantially parallel to the extension portion 160 of the tab 156. In one example embodiment, the tab 156 is equidistant from the first segment 110 and the second segment 120. It will, however, be appreciated that a suitable alternative barrier member (not shown) could have a tab positioned other than equidistant from segments, without departing from the scope of the disclosed concept.

In one non-limiting preferred embodiment, the barrier member 100 is a unitary component that is made from a single piece of material. For example and without limitation, the barrier member 100 may be manufactured by, for example, stamping a flat piece of metal, and bending the barrier member into shape. It will, however, be appreciated that other suitable alternative manufacturing processes are contemplated herein. Furthermore, a similar suitable alternative barrier member (not shown) may be made of multiple pieces, without departing from the scope of the disclosed concept.

Figure 11:
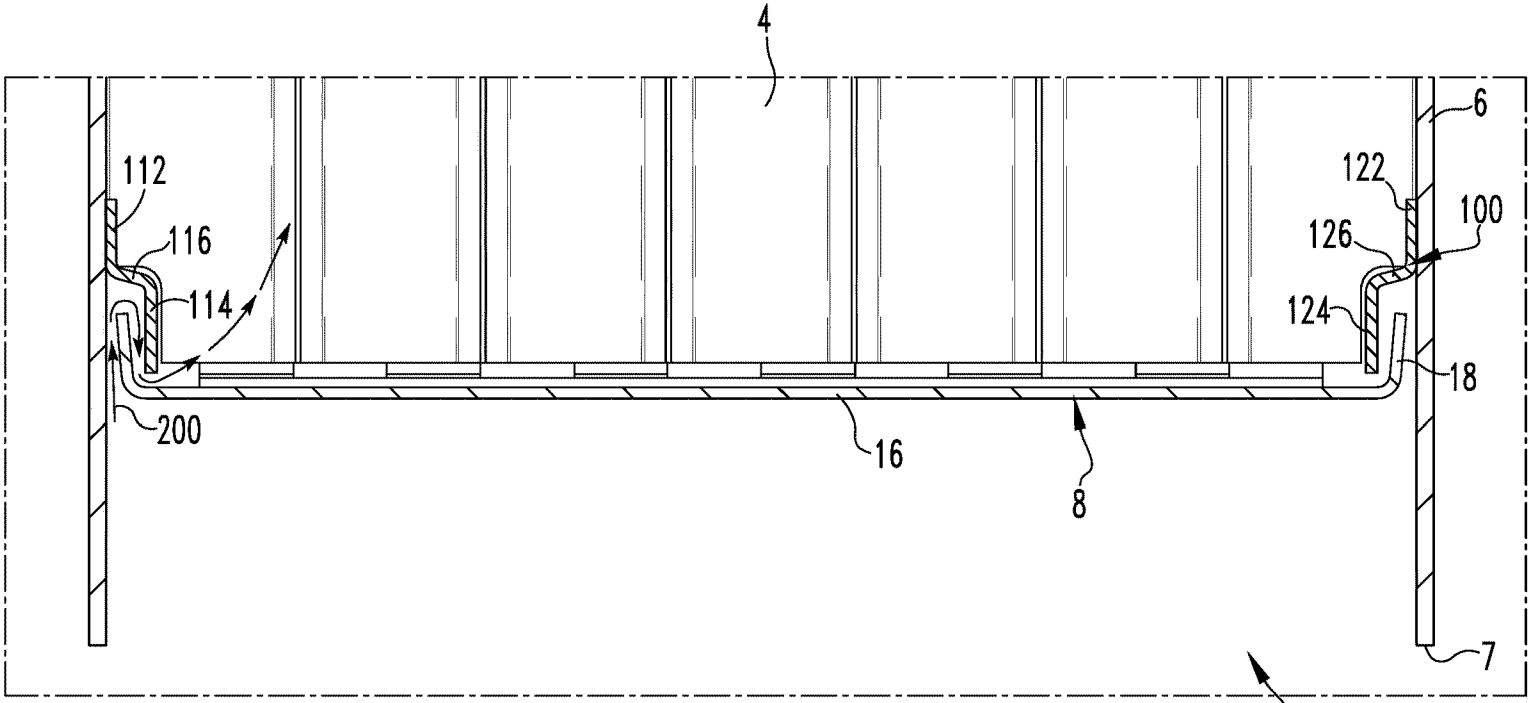
FIG. 11 is an enlarged view of a portion of the mailbox and barrier member therefor of FIG. 10.

Referring to FIGS. 10-13, the assembly of the barrier member 100 in the mailbox 2, and the advantages associated therewith, will now be discussed in greater detail. As shown in FIG. 11, the coupling portions 112,122 of the barrier member 100 are coupled to the wrap member 6. In one example embodiment, the coupling portions 112,122 are each welded to the wrap member 6. Furthermore, in accordance with the disclosed concept, the barrier member 100 sealingly cooperates with the flange 18 of the door 8. More specifically, when the door 8 is in the closed position, the flange 18 is located internal (i.e., is surrounded by and/or is enclosed by) with respect to the wrap member 6, and together with the first and second segments 110,120 of the barrier member 100, operates to substantially minimize the ingress of water into the interior of the mailbox 2 such as, for example, during a thunderstorm or during UL testing.

As shown in FIG. 11, when the door 8 is in the closed position, the flange 18 is located between the wrap member 6 and the first extension portion 114, and between the wrap member 6 and the second extension portion 124. As a result, the potential for ingress of water into the interior of the mailbox 2 is relatively difficult. See, for example and without limitation, an example water flow path 200, depicted in FIG. 11. As shown, water would have to enter the mailbox 2 between the flange 18 and the wrap member 6, turn 180 degrees and flow between the flange 18 and the extension portion 114 of the barrier member 100, and then flow toward the interior of the mailbox 2. While it is possible for water to flow along flow path 200, it will be appreciated that the conditions to cause water to follow this path 200 (i.e., and a similar flow path proximate extension portion 124) would have to be extremely severe, and in any event more severe than those occurring during UL 771 testing.

Figure 3:
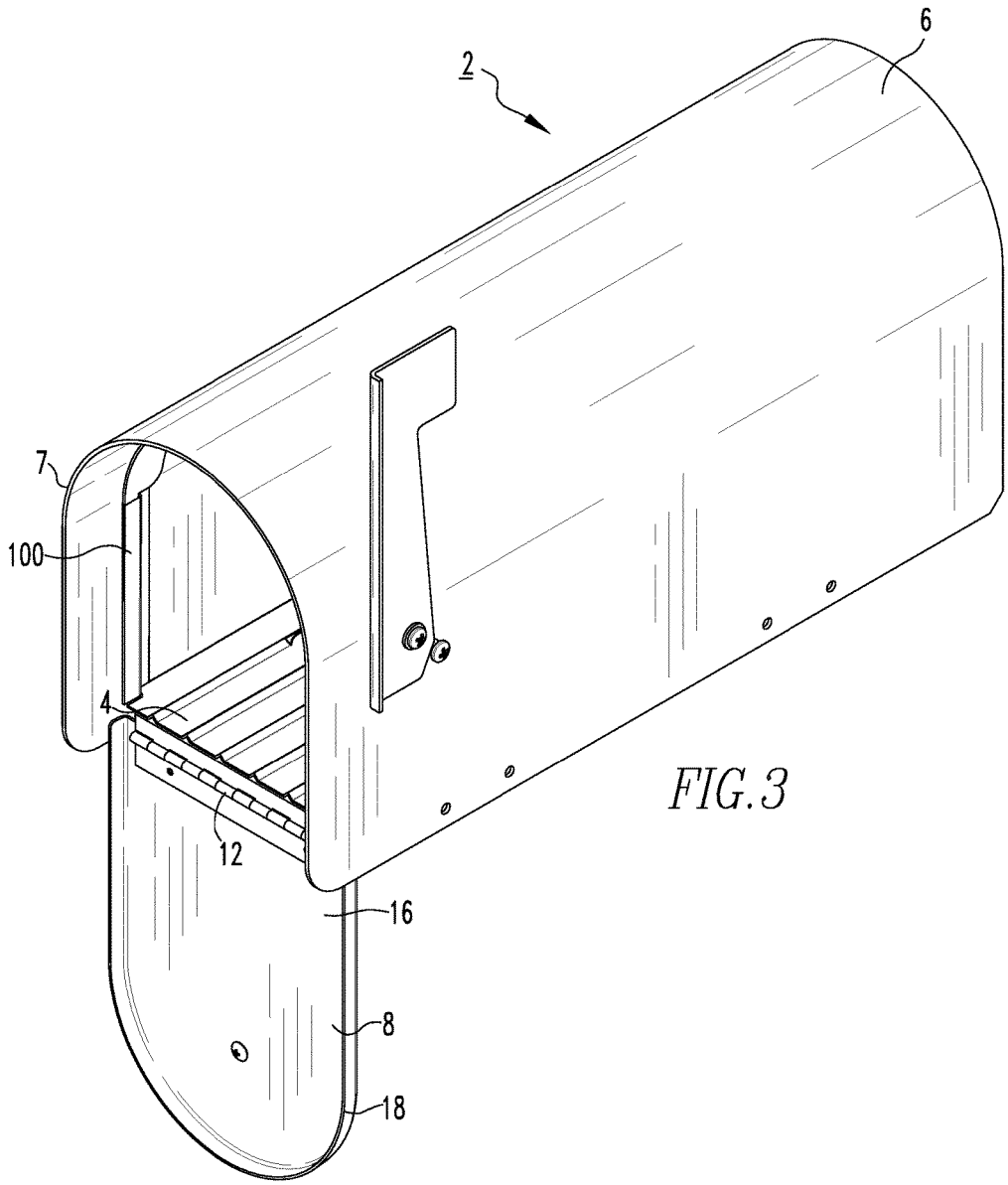
FIG. 3 is another front isometric view of the mailbox of FIG. 1, showing a barrier member, and shown with the door in an open position.
Figure 4:
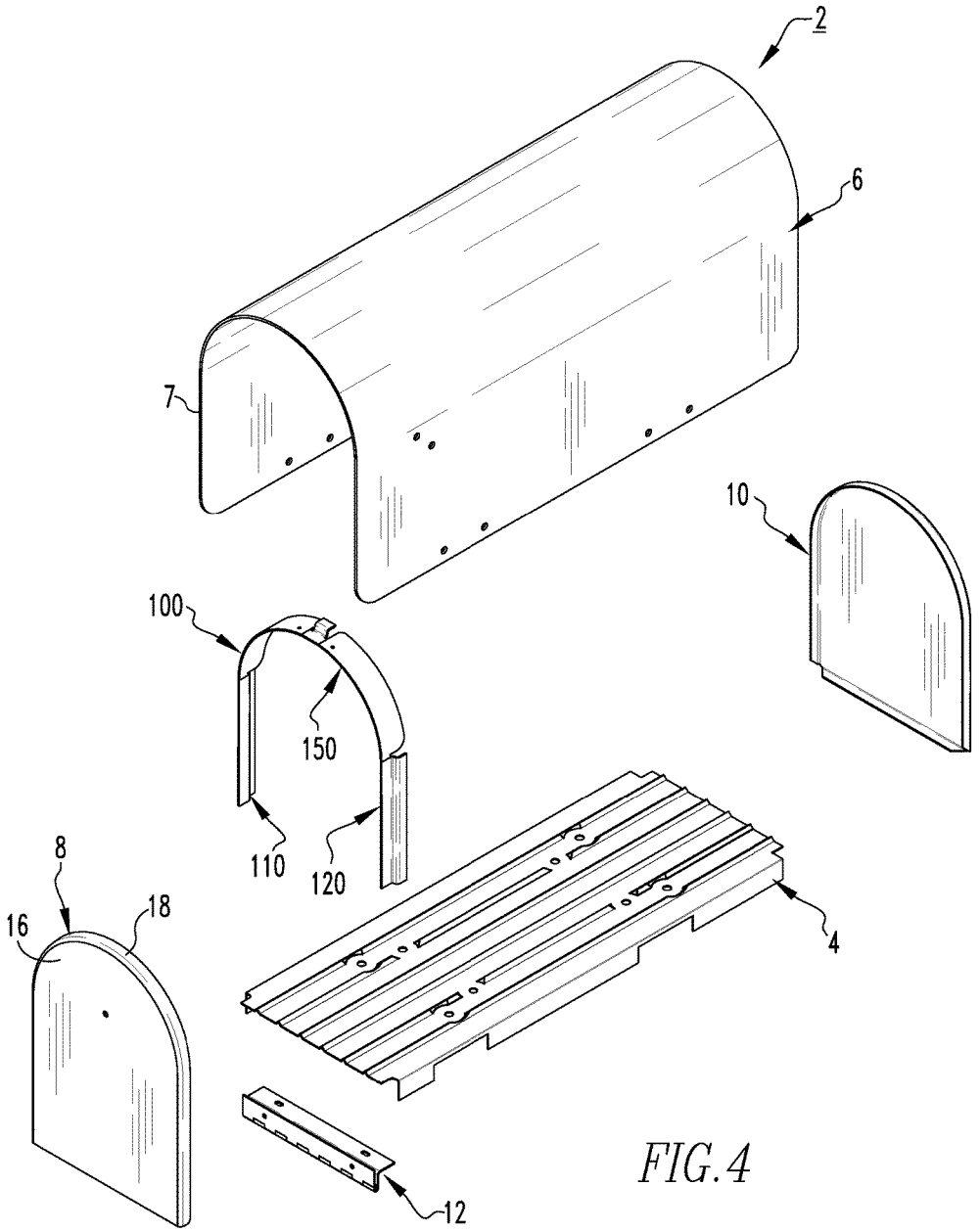
FIG. 4 is an exploded front isometric view of a portion of the mailbox and barrier member therefor of FIG. 3.
Figure 5:
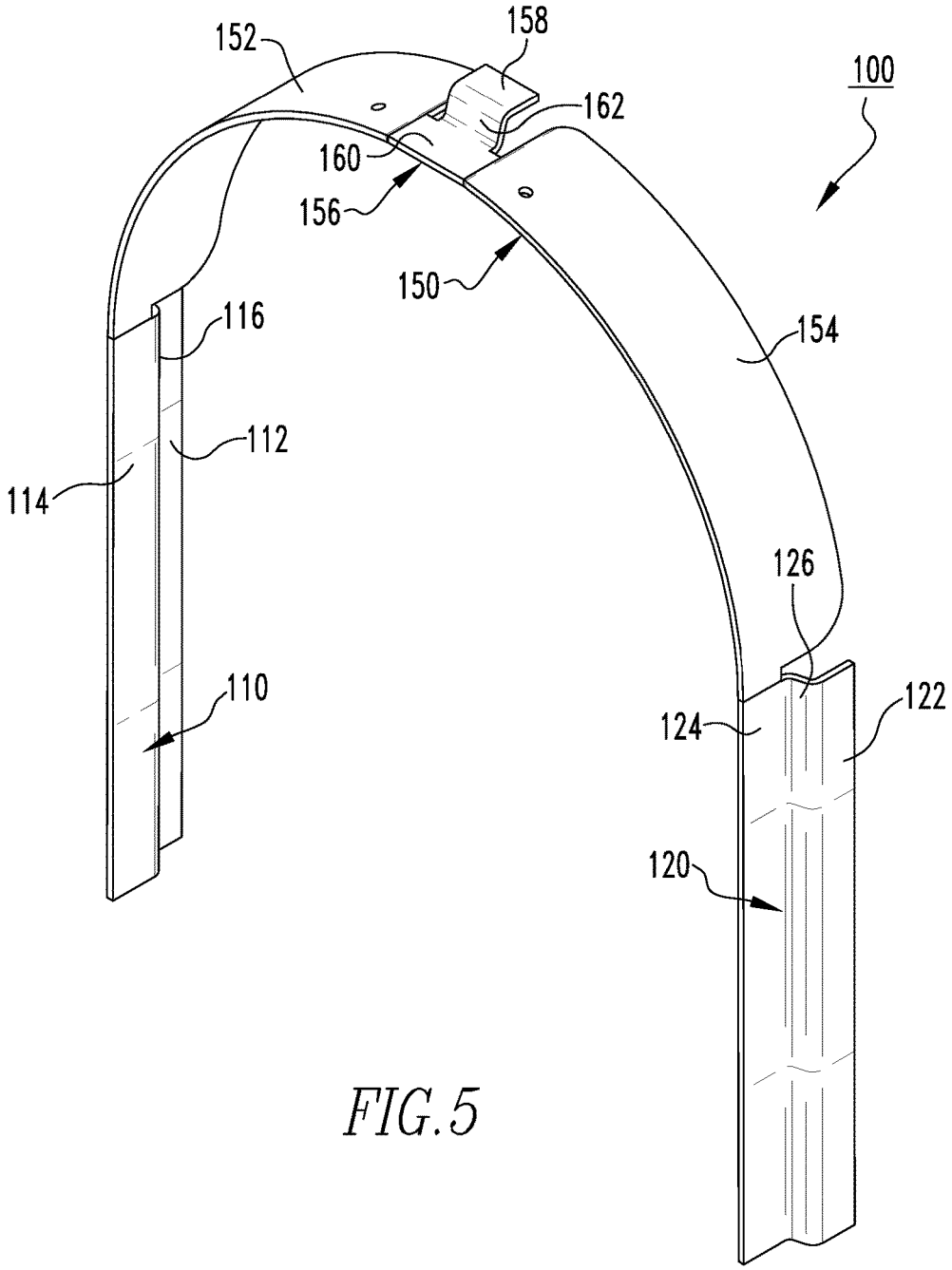
FIG. 5 is a front isometric view of the barrier member of FIG. 4.
Figure 7:
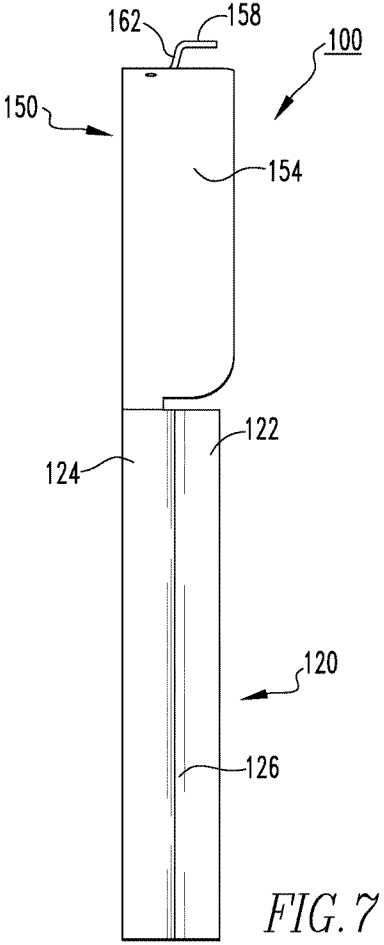
FIG. 7 is a right side elevation view of the barrier member of FIG. 6.
Figure 6:
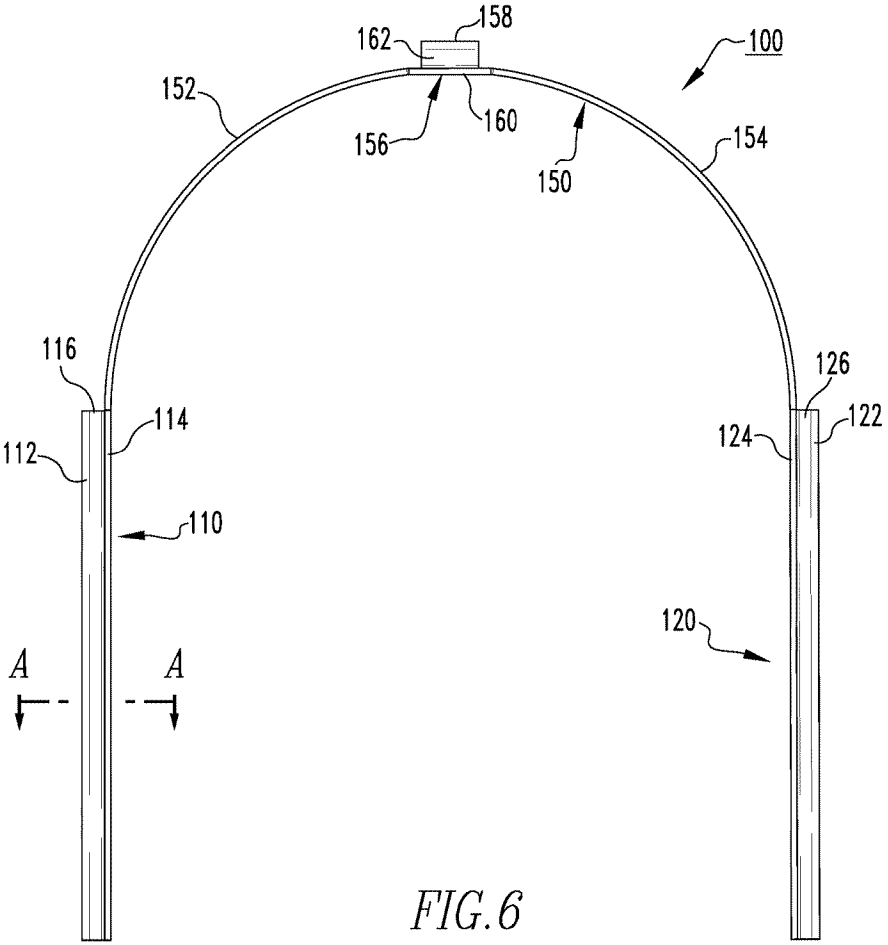
FIG. 6 is a front elevation view of the barrier member of FIG. 5.
Figure 8:
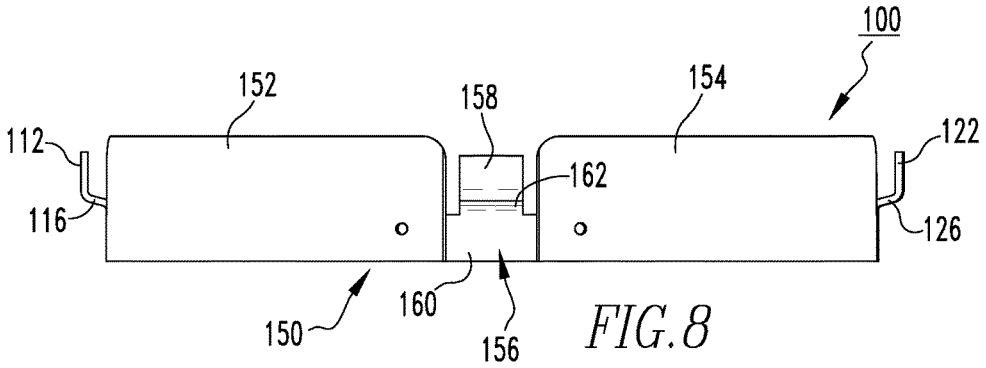
FIG. 8 is a top plan view of the barrier member of FIG. 6.
Figure 9:
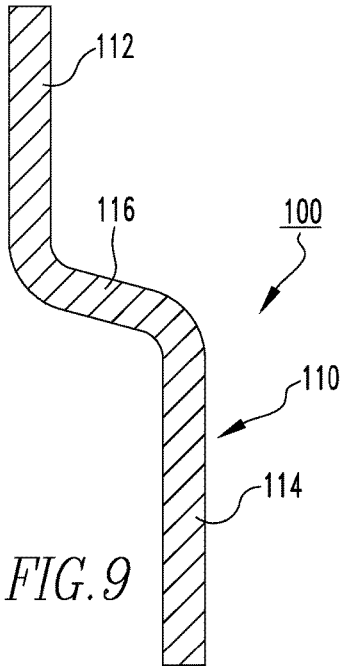
FIG. 9 is a section view of the barrier member of FIG. 6, taken along line A-A of FIG. 6.
Figure 10:
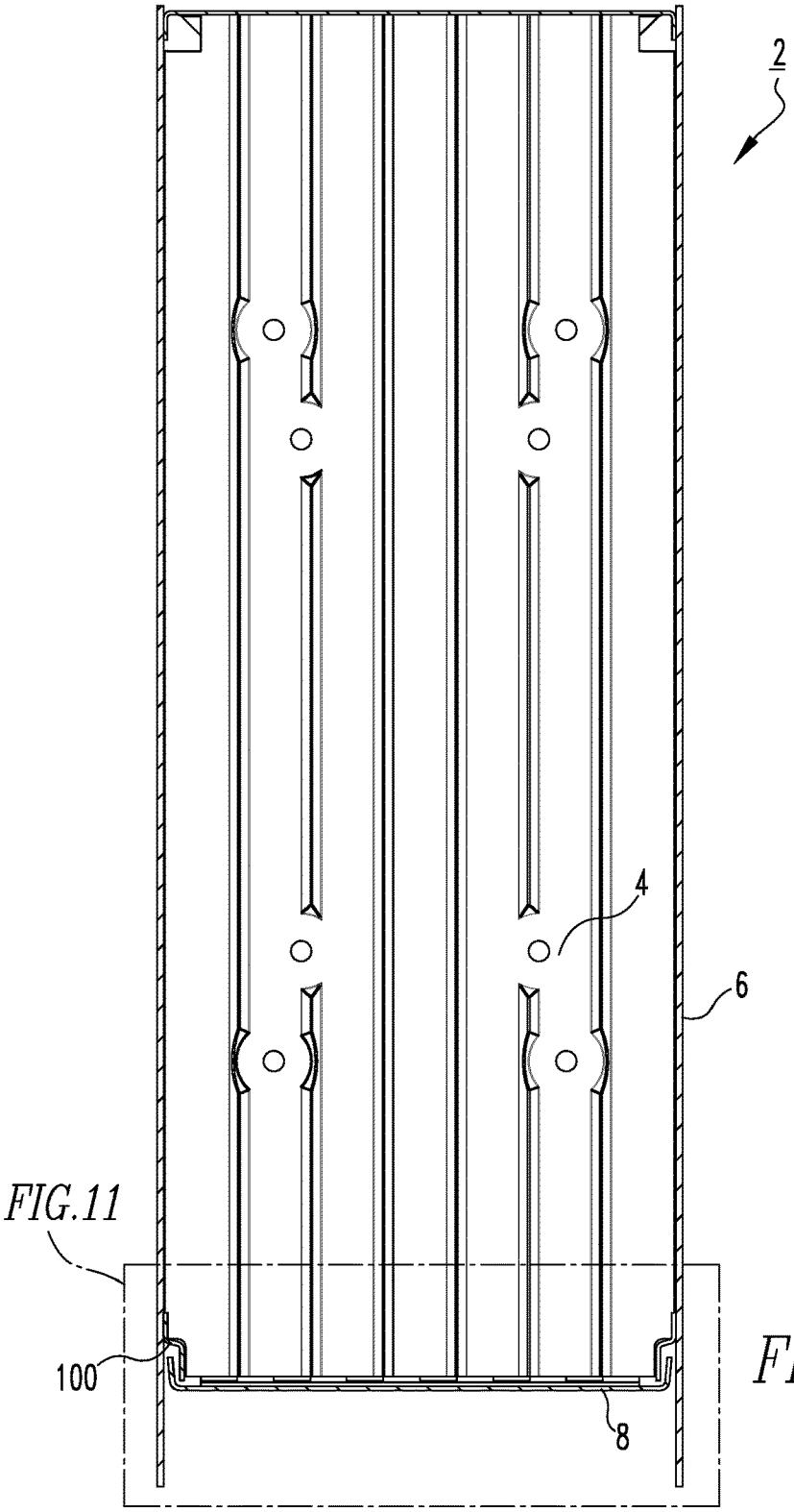
FIG. 10 is a section view of the mailbox and barrier member therefor of FIG. 2, taken along line B-B of FIG. 2.

Furthermore, the position of the door 8 and the barrier member 100 with respect to the wrap member 6 also advantageously functions to minimize the likelihood that water might enter into the interior of the mailbox 2. See, for example, FIGS. 1 and 3. As shown in FIG. 3, the wrap member 6 has a distal edge portion 7 located proximate the barrier member 100. When the door 8 is in the closed position (FIG. 1), the door 8 does not engage the distal edge portion 7. As such, the wrap member 6 provides an overhang, or, an additional barrier against potential undesirable water ingress into the interior of the mailbox 2. That is, much of the water that might otherwise have a direct path between the wrap member 6 and the door 8 will engage the wrap member 6 and be prevented from entering the interior of the mailbox 2. Accordingly, water will generally have to be traveling (i.e., be sprayed during UL testing or be swirling during a thunderstorm) at an angle (i.e., a 45 degree angle) with respect to the floor member 4 (FIGS. 3 and 4) to enter flow path 200 (FIG. 11). Otherwise, water that is sprayed, or rain that falls, vertically (i.e., at a 90 degree angle with respect to the floor member 4 (FIGS. 3 and 4)), will generally engage the overhanging portion of the wrap member 6 and not enter flow path 200 (FIG. 11).

Figure 12:
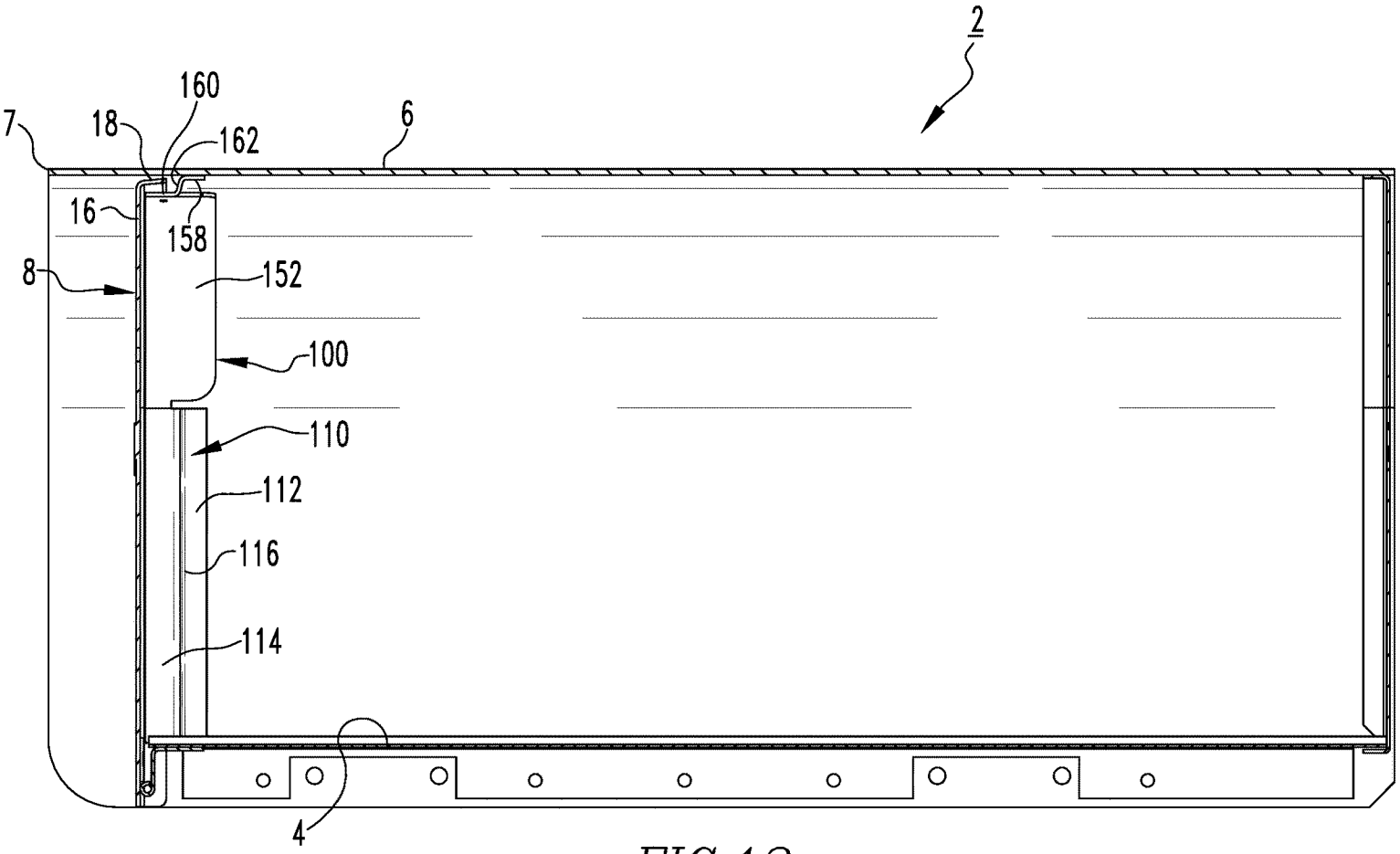
FIG. 12 is a section view of the mailbox and barrier member therefor of FIG. 2, taken along line C-C of FIG. 2.

It will also be appreciated that because the wrap member 6 extends over the door 8 and the barrier member 100, the first and second segments 110,120 need not extend around the entirety of the barrier member 100. That is, the first and second segments 110,120 generally need only extend from the floor member 4 midway to the top of the wrap member 6, as shown in FIG. 12. This is advantageous for purposes of manufacturing in that bending a piece of material with a continuous offset into the general shape of a barrier member would prove rather difficult. The barrier member 100, however, with the first and second segments 110,120, and first and second sides 152,154 extending from extension portions 114,124 is advantageously relatively simple to bend into shape.

Continuing to refer to FIG. 12, the coupling portion 158 is coupled to the wrap member 6. In one example embodiment, the coupling portion 158 is welded to the wrap member 6. Furthermore, as shown, the first side 152 is spaced from the wrap member 6, and when the door 8 is in the closed position, the flange 18 is located between the extension portion 160 and the wrap member 6. It will also be appreciated that second side 154 (not shown in FIG. 12) is spaced from the wrap member 6. As a result of the spacing of the first and second sides 152,154 from the wrap member 6, the mailbox 2 is advantageously able to be manufactured with less components.

Figure 13:
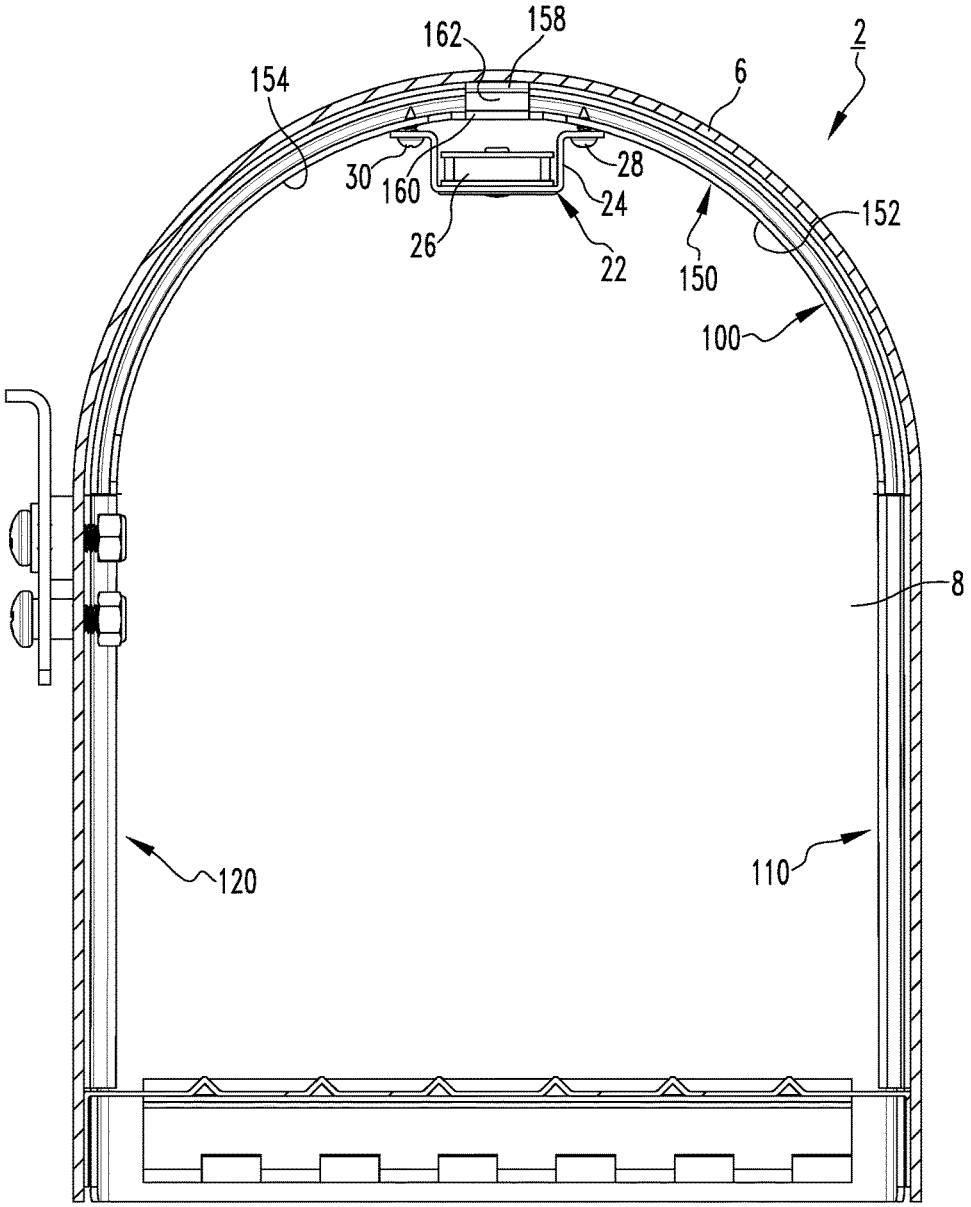
FIG. 13 is a section view of the mailbox and barrier member therefor of FIG. 1, taken along line D-D of FIG. 1.

More specifically, as shown in FIG. 13, the mailbox 2 further includes a magnet assembly 22 having only one single bracket member 24, a magnet 26 coupled to the bracket member 24, and a number of coupling members 28,30 extending through the bracket member 24 and the barrier member 100 (i.e. through the first and second sides 152,154) in order to couple the magnet assembly 22 to the barrier member 100. When the door 8 is in the closed position, the magnet 26 maintains the door 8 in the closed position in a generally well known manner. In one example embodiment, the coupling members 28,30 are spaced from the wrap member 6. Known mailboxes and magnet assemblies therefor (not shown) generally require multiple bracket members to mount magnets to wrap members. For example, it is generally not desirable or feasible to directly mount primary bracket members to wrap members because to do so would result in a hole in the wrap member, a hole through which water could pass into the mailbox interior. As a result, known mailboxes generally require additional bracket members that connect to the primary bracket member. In accordance with the instant disclosed concept, the configuration of the mailbox 2 and barrier member 100 therefor advantageously provides a novel location on which a primary bracket member (i.e., the bracket member 24) can be mounted. That is, because the first and second sides 152,154 are spaced from the wrap member 6 and located in the interior of the mailbox, coupling members 28,30 can be extended therethrough without resulting in additional water ingress into the interior of the mailbox 2. As a consequence, additional bracket members are not needed, thus saving cost and simplifying assembly.

As mentioned above, the coupling portions 112,122 (see FIG. 5) of the first and second segments 110,120, and the coupling portion 158 of the tab 156 (see FIG. 5) are each coupled, in one example embodiment they are welded, to the wrap member 6. These three contact points between the barrier member 100 and the wrap member 6 provide a relatively secure mechanism to retain and stabilize the barrier member 100 on the wrap member 6. As such, a further function of the barrier member 100 is to provide structural support to the mailbox 2. As a result, loads such as, for example, impact loads imparted by the USPS during delivery of mail, will not compromise the integrity of the mailbox 2 as much as mailboxes that do not have such barrier members.

Accordingly, it will be appreciated that the disclosed concept provides for an improved (e.g., without limitation, better able to protect against water ingress during a thunderstorm, able to pass UL 771 testing, and able to be manufactured with less components) mailbox 2 and barrier member 100 therefor, in which the barrier member 100 sealingly cooperates with a door 8 of the mailbox 2 to substantially minimize the likelihood that water such as, for example, during a thunderstorm or during UL testing, will enter into the interior of the mailbox.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A barrier member for a mailbox, said mailbox comprising a floor member, a wrap member coupled to said floor member, a panel member coupled to said wrap member and said floor member, and a door pivotably coupled to said floor member, said door being structured to pivot between an open position and a closed position, said barrier member comprising:

a first segment;

a second segment opposite and disposed substantially parallel to said first segment; and a band connecting said first segment to said second segment, wherein said barrier member is structured to sealingly cooperate with said door; wherein said band comprises a first side, a second side disposed opposite said first side, and a tab connecting said first side to said second side; wherein said first side extends from said first segment; wherein said second side extends from said second segment; and wherein said tab is equidistant from said first segment and said second segment.

2. The barrier member of claim 1 wherein said first segment comprises a first coupling portion structured to be coupled to said wrap member; wherein said second segment comprises a second coupling portion structured to be coupled to said wrap member; and wherein said band is spaced from said first coupling portion and said second coupling portion.

3. The barrier member of claim 2 wherein said first segment comprises a first extension portion offset from said first coupling portion; wherein said second segment comprises a second extension portion offset from said second coupling portion; and wherein said band connects said first extension portion to said second extension portion.

4. The barrier member of claim 3 wherein said first coupling portion is spaced from and disposed substantially parallel to said first extension portion; and wherein said second coupling portion is spaced from and disposed substantially parallel to said second extension portion.

5. The barrier member of claim 3 wherein each of said first coupling portion, said second coupling portion, said first extension portion, and said second extension portion is generally planar.

6. The barrier member of claim 1 wherein said tab comprises a coupling portion and an extension portion offset from said coupling portion; wherein said coupling portion is structured to be coupled to said wrap member; and wherein said extension portion extends from said first side and said second side of said band.

7. The barrier member of claim 6 wherein said coupling portion is spaced from and disposed substantially parallel to said extension portion.

8. A mailbox comprising:

a plurality of components comprising a floor member, a wrap member coupled to said floor member, a panel member coupled to said wrap member and said floor member, a door pivotably coupled to said floor member, said door being structured to pivot between an open position and a closed position; and a barrier member comprising:

a first segment, a second segment opposite and disposed substantially parallel to said first segment, and a band connecting said first segment to said second segment, wherein said barrier member sealingly cooperates with said door; wherein said door comprises a body and a flange extending outwardly from said body; wherein, when said door is in the closed position, said barrier member sealingly cooperates with said flange; wherein said band comprises a first side, a second side disposed opposite said first side, and a tab connecting said first side to said second side; wherein said first side extends from said first segment; wherein said second side extends from said second segment; and wherein said tab is equidistant from said first segment and said second segment.

9. The mailbox of claim 8 wherein, when said door is in the closed position, said flange is disposed internal with respect to said wrap member.

10. The mailbox of claim 8 wherein said first segment comprises a first extension portion extending from said band; wherein said second segment comprises a second extension portion extending from said band; wherein, when said door is in the closed position, said flange is disposed between said wrap member and said first extension portion, and between said wrap member and said second extension portion.

11. The mailbox of claim 10 wherein said wrap member has a distal edge portion disposed proximate said barrier member; and wherein, when said door is in the closed position, said door does not engage said distal edge portion.

12. The mailbox of claim 10 wherein said first segment further comprises a first coupling portion coupled to said wrap member; wherein said second segment further comprises a second coupling portion coupled to said wrap member; and wherein said band is spaced from said first coupling portion and said second coupling portion.

13. The mailbox of claim 8 wherein said tab comprises a coupling portion, an extension portion, and a connecting portion connecting said coupling portion to said extension portion; wherein said coupling portion is coupled to said wrap member; wherein said extension portion extends from said first side and said second side of said band; and wherein said coupling portion is spaced from and disposed substantially parallel to said extension portion.

14. A mailbox comprising:

a plurality of components comprising a floor member, a wrap member coupled to said floor member, a panel member coupled to said wrap member and said floor member, a door pivotably coupled to said floor member, said door being structured to pivot between an open position and a closed position; and a barrier member comprising:

a first segment, a second segment opposite and disposed substantially parallel to said first segment, and a band connecting said first segment to said second segment, wherein said barrier member sealingly cooperates with said door, wherein said first segment and said second segment are each welded to said wrap member; wherein said band comprises a first side, a second side disposed opposite said first side, and a tab connecting said first side to said second side; wherein said first side extends from said first segment; wherein said second side extends from said second segment; wherein said tab is equidistant from said first segment and said second segment; wherein said tab is welded to said wrap member; and wherein said first side and said second side are each spaced from said wrap member.

15. A mailbox comprising:

a plurality of components comprising a floor member, a wrap member coupled to said floor member, a panel member coupled to said wrap member and said floor member, a door pivotably coupled to said floor member, said door being structured to pivot between an open position and a closed position; and a barrier member comprising:

a first segment, a second segment opposite and disposed substantially parallel to said first segment, and a band connecting said first segment to said second segment, wherein said barrier member sealingly cooperates with said door, wherein the plurality of components further comprises a magnet assembly comprising only one single bracket member, a magnet coupled to said bracket member, and a number of coupling members extending through said bracket member and said barrier member in order to couple said magnet assembly to said barrier member; wherein, when said door is in the closed position, said magnet maintains said door in the closed position; and wherein said number of coupling members are spaced from said wrap member.

* * * * *